US006972053B2

(12) United States Patent
Ziwica et al.

(10) Patent No.: US 6,972,053 B2
(45) Date of Patent: Dec. 6, 2005

(54) INSTALLATION FOR COATING A WORKPIECE WITH POWDER

(75) Inventors: Daniel Ziwica, Arbon/TG (CH); Wolfgang Keller, Wald/Ruhestetten (DE)

(73) Assignee: J. Wagner AG, Altstatten (CH)

( * ) Notice: Subject to any disclaimer, the term of this patent is extended or adjusted under 35 U.S.C. 154(b) by 1 day.

(21) Appl. No.: 10/700,186

(22) Filed: Nov. 3, 2003

(65) Prior Publication Data

US 2004/0134422 A1 Jul. 15, 2004

(30) Foreign Application Priority Data

Nov. 8, 2002 (DE) ..... 202 17 416 U

(51) Int. Cl.[7] ..... B05B 3/00; B05C 15/00; B05C 19/00

(52) U.S. Cl. ..... 118/323; 118/309; 118/313

(58) Field of Search ..... 118/309, 321, 323, 118/326, 313, 308; 454/50; 55/DIG. 46

(56) References Cited

U.S. PATENT DOCUMENTS 4,381,729 A 5/1983 Gernez
4,997,502 A 3/1991 Schnaars
6,033,135 A * 3/2000 An et al. ..... 396/611
6,730,167 B2 * 5/2004 Shutic et al. ..... 118/309

FOREIGN PATENT DOCUMENTS

| | | |
|---|---|---|
| DE | 694 15 334 | 9/1933 |
| DE | 729 469 C | 12/1942 |
| DE | 195 46 970 | 6/1997 |
| DE | 195 45 261 | 7/1998 |
| DE | 198 11 085 | 9/1999 |
| DE | 201 07 767 | 5/2001 |

OTHER PUBLICATIONS

German Search Report regarding Application No. 202 17 416.6 dated Dec. 9, 2002.
EP Search Report, EP 03 40 5774, dated Mar. 31, 2004.

* cited by examiner

*Primary Examiner*—Chris Fiorilla
*Assistant Examiner*—Yewebdar Tadesse
(74) *Attorney, Agent, or Firm*—Renner, Otto, Boisselle & Sklar, LLP

(57) ABSTRACT

The installation for coating a workpiece with powder in accordance with the invention comprises a powder spray device and a guide arm, the powder spray device being supported in such a manner as to be rotatable with respect to the guide arm around a rotation axis and giving rise to a principal powder spraying direction that differs from the rotation axis.

13 Claims, 4 Drawing Sheets

INSTALLATION FOR COATING A WORKPIECE WITH POWDER

TECHNICAL FIELD

The invention relates to an installation for coating a workpiece with powder lacquer. The process in question is an electrostatic powder coating in which the workpiece to be coated is covered with a layer of electrostatically charged powder. In a subsequent working step the workpiece coated with powder is heated, so that the powder liquefies on the surface of the workpiece and after cooling comes to form a continuous protective layer.

RELEVANT ART

From prior art there is known a powder coating plant in which, as shown in FIG. 1, the workpieces 4 are transported into a booth 1 in order to be there coated with the help of one or more powder spray pistols 2. To this end the workpiece is moved though the booth suspended either from a guide rail or a conveyor belt 6. The booth 1 is therefore provided with an appropriate opening in the roof 11. Depending on the particular geometric configuration of the workpiece that is to be coated, it may be necessary to resort to manual coating for parts of the workpiece 4 that either cannot be reached with the help of the automatic spray pistols 2 or cannot be given a coating of adequate quality. The booth 1 is therefore provided with an area for manual coating, which can be reached by means of the door 9 in the longitudinal side 8.1 of the booth 1. In the embodiment shown in FIG. 1, several spray pistols 2 are attached, parallel with each other and side by side, to a guide arm 3 in the area of the booth 1 in which the automatic coating takes place. The guide arm 3 is designed in such a manner that the powder spray pistols 2 can be moved both in the vertical direction, hereinafter also referred to as the y-direction, and in the horizontal direction at right angles to the transport direction of the workpiece 4, hereinafter also referred to as the z-direction. The part of the powder that does not adhere to the workpiece 4 that is to be coated is sucked out of the booth 1 by means of an exhaust duct 10 and collected in a container not shown in FIG. 1. This excess powder can subsequently be reused for coating purposes. The entire powder coating installation can be steered by means of a control panel 5.

An embodiment of the type shown in FIG. 1 is however associated with a series of drawbacks. First of all, the coating of complicated workpieces calls for the use of additional personnel to coat certain parts of the workpiece by hand. As a general rule, however, manual coating leads to greater production tolerances, in the coating thickness for example, than would be needed in case of automatic machine coating. Furthermore, this solution may bring with it an increased powder consumption, since certain parts of the workpiece will receive an excessive powder application as a result of the manual coating, or because the arrangement of the powder spray pistols 2 calls for the spraying of more powder before not readily accessible parts of the workpiece can be provided with an adequate coating thickness. A considerable proportion of the powder does not reach the desired parts of the workpiece and is not therefore available for coating purposes. Although a substantial part of the powder that does not adhere to the workpiece can be recuperated via the exhaust duct 10 and a recovery plant associated with it and can therefore be re-used, this renders operation of the installation more expensive, because greater use will have to be made of the recovery plant. Moreover, the extra man required to perform the manual coating will step up the overall coating cost.

SUMMARY OF THE INVENTION

It is therefore an object of the invention to disclose an installation for coating a workpiece with powder that will make it possible to apply high-quality coatings with a high application efficiency and the least possible powder consumption even to workpieces of complicated geometric shape.

Advantageously, the installation in accordance with the invention makes it possible to do without additional manual coating. It also makes it possible to obtain a high constancy of quality.

The task is solved by means of an installation for coating a workpiece with powder having the characteristics set out in claim 1 herein below.

The installation for coating a workpiece with powder in accordance with the invention thus comprises a powder spray device and a carrier element, the powder spray device being supported in such a manner as to be capable of being rotated about a rotation axis and with respect to the carrier element. The powder spray device has a principal powder spraying direction that differs from the rotation axis.

Advantageous further developments of the invention derive from the characteristics set out in the dependent claims.

In one embodiment of the installation in accordance with the invention the powder spray device is provided with a nozzle, where the orientation of the nozzle defines the principal spraying direction.

Advantageously, the powder spray device is designed as a spray pistol. This has the advantage that the exchangeability and flexibility can be enhanced. Depending on the purpose for which the installation is to be used, spray pistols suitable for the various use conditions can be mounted.

According to a preferred embodiment of the installation in accordance with the invention, there is provided a booth into which the powder spray device projects. The carrier element is provided with a mounting and a guide arm, the powder spray device being connected to the guide arm by means of the mounting and both the guide arm and the mounting being arranged outside the booth. This has the advantage that fewer components of the installation in accordance with the invention can come into contact with the powder. The cost of cleaning the installation can thus be reduced.

In a further development of the installation in accordance with the invention the guide arm has a first linear axle by means of which the powder spray device can be made to perform a translatory movement along a first axis. The additional degree of freedom thus obtained makes it possible to step up the number of workpiece shapes that can be coated.

Over and above this, the installation in accordance with the invention can also be provided with a second linear axle that is connected with the first linear axle and by means of which the powder spray device can be made to perform a translatory movement along a second axis. This additional degree of freedom makes it possible to further increase the number of the different workpiece shapes that can be coated and thus further enhances the usability and flexibility of the installation in accordance with the invention.

Furthermore, the guide arm may likewise be designed so as to be capable of being moved horizontally by means of a drive.

With a view to solving the task, it is further suggested that the mounting should be provided with a drive for the rotation of the powder spray device. The powder spray device can therefore be structured in a compact manner.

In a further development of the installation for coating workpieces the drive comprises a step motor. The principal spraying direction can therefore be set in a very simple manner. The drive can be built into the mounting.

In order to step up the rate at which powder can be applied or to speed up the coating, according to a preferred embodiment of the installation in accordance with the invention the first powder spray device may be supplemented by a further powder spray device. This also makes it possible to reduce the overall energy consumption and the necessary quantity of air.

Advantageously, the two powder spray devices will be connected with the guide arm by means of a common mounting and the first and/or the second linear axle. This makes it very simple for the two powder spray devices to be moved in synchrony with each other.

With a view to solving the task, it is further suggested that the second powder spry device should be connected with the guide arm by means of a second mounting. This assures a further degree of freedom and makes possible the autonomous operation of the two powder spray devices.

Over and above this, the installation in accordance with the invention may be such that the first powder spray device is arranged on a first longitudinal side of the booth and the second powder spray device on the second longitudinal side of the booth.

This will increase the flexibility and usability of the installation in accordance with invention even further. In this way workpieces can be coated on their front and rear side without their having to be rotated.

With a view to solving the task, it is further suggested that the installation in accordance with the invention should be provided with a control for the rotation and translation of the powder spray device.

Lastly, it is suggested that the installation in accordance with the invention should be provided with a third linear axle by means of which the guide arm can be moved along a third axis.

BRIEF DESCRIPTION OF THE DRAWINGS

Several embodiments of the invention will now be described in greater detail with the help of five figures.

DETAILED DESCRIPTION OF THE INVENTION

Figure 1:
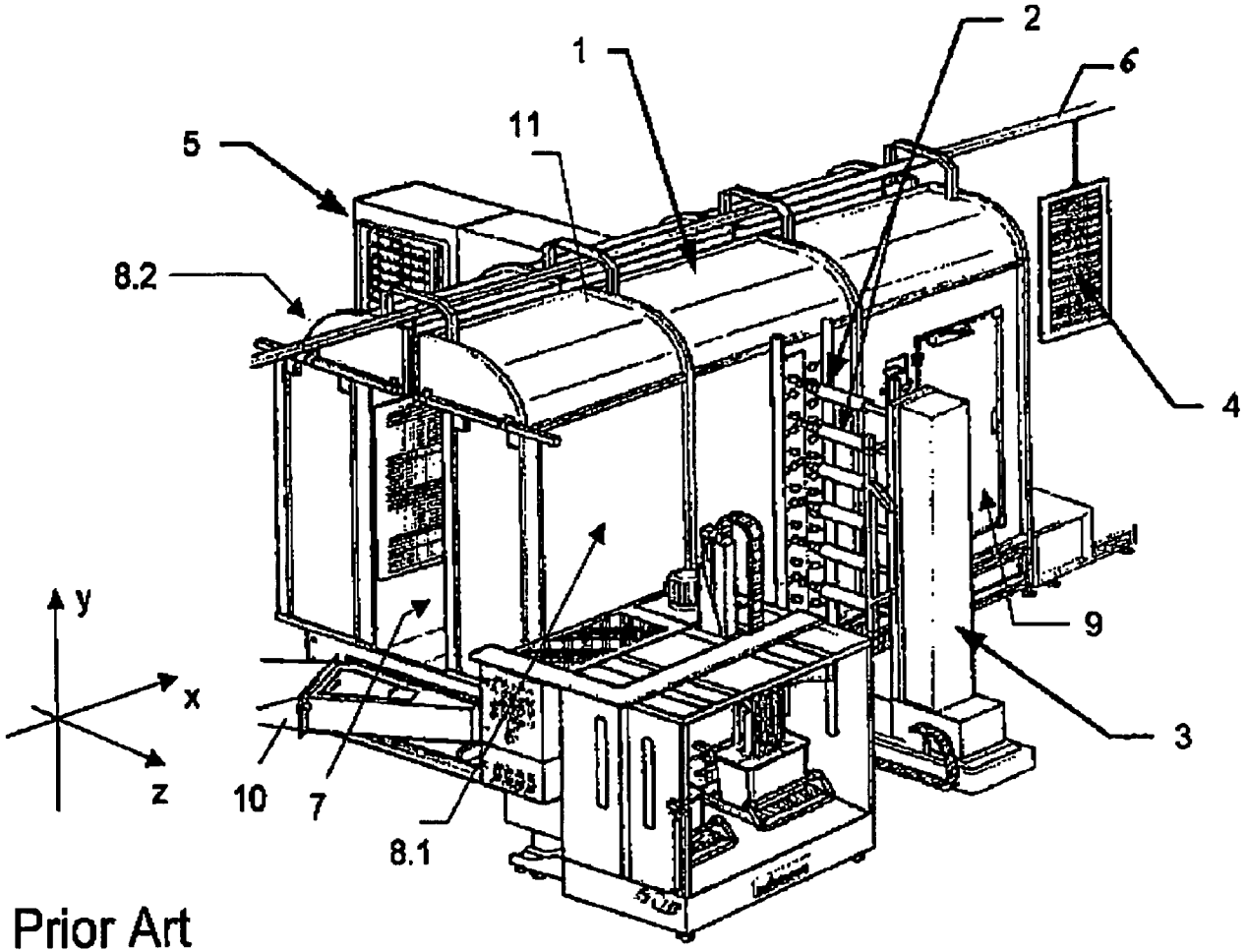
Prior Art Fig. 1
FIG. 1 shows a powder coating booth with several automatically operating powder spray pistols that is well known from prior art.

The powder coating installation shown in FIG. 1 has already been discussed in the descriptive introduction. It will not therefore be further considered in the present context.

Figure 2:
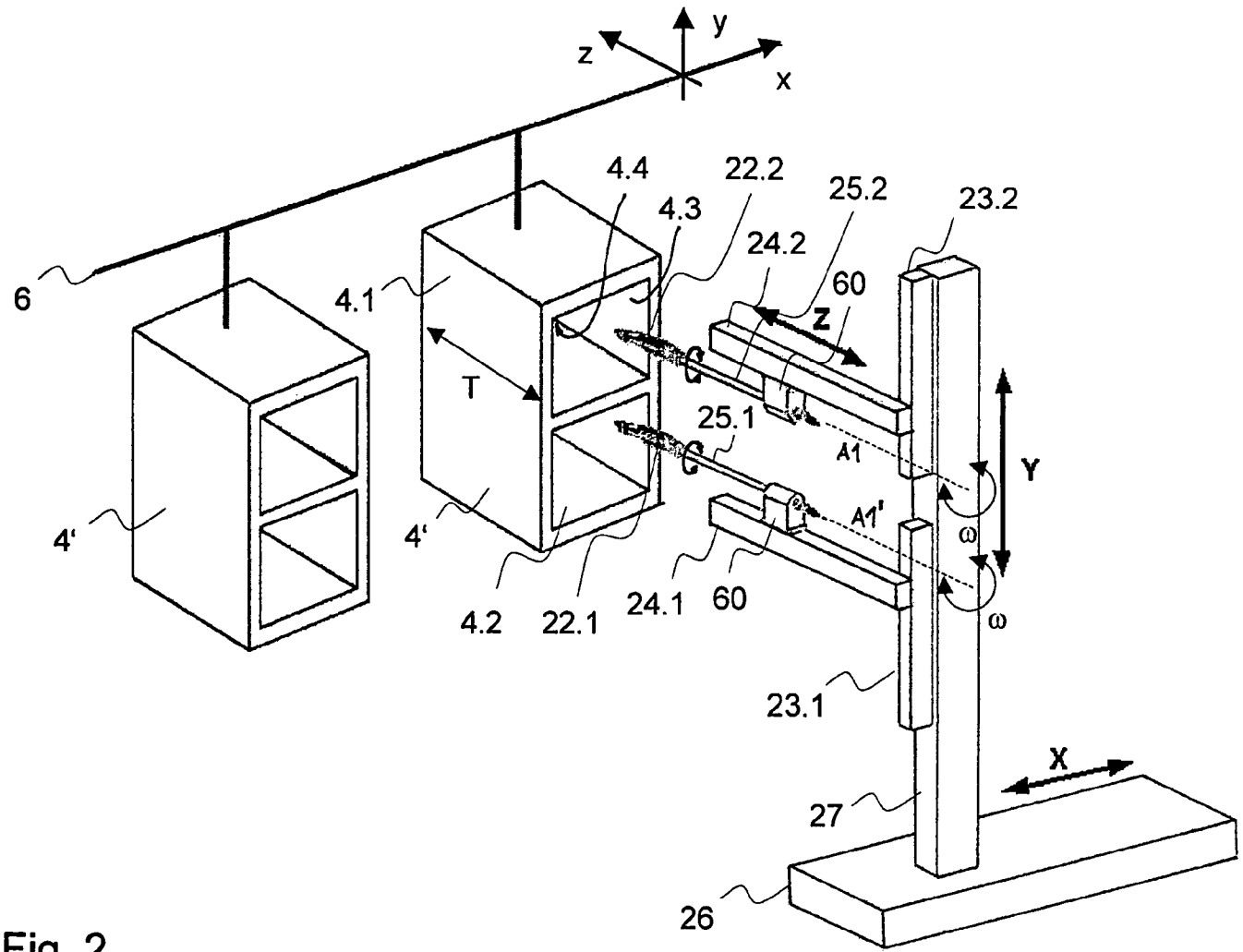
FIG. 2 shows in the form of a conceptual sketch a possible embodiment of the installation for coating workpieces with powder in accordance with the invention.

For the sake of simplicity, the embodiment of the installation for coating workpieces with powder in accordance with the invention shown in FIG. 2 has been drawn without the booth that surrounds the conveyor belt 6 in the vicinity of the powder spray devices 22.1 and 22.2. The workpieces 4' suspended from the conveyor belt 6, which differ from the workpiece 4 of FIG. 1 by the fact of, for example, having one or more hollows 4.2 and 4.3, are led past the two powder spray devices 22.1 and 22.2. By means of respective mountings 60, each of the powder spray devices 22.1 and 22.2 is connected with a guide arm 27. The mountings 60 will be considered in greater detail in connection with FIGS. 5A and 5B. The guide arm 27 is supported in such a way as to permit it to be moved in the x-direction within certain limits, so that during the time needed to coat the workpiece 4' the guide arm 27 can be moved parallel to the conveyor belt 6 and the workpiece 4' and can therefore follow the workpiece 4'. This assures that for the duration of the coating the two spray pistols 22.1 and 22.2 can move at right angles to the transport direction x without changing their relative position with respect to the workpiece 4' in the x-direction. In this way the side 4.1 with the depth T of the workpiece can be coated from an invariant distance between spray pistol 22.1 and 22.2 and the side wall 4.1. The same applies as regards the two hollows 4.2 and 4.3 of the workpiece 4'. Two linear axles 24.1 and 24.2 are provided on the guide arm 27 in order to permit the two spray pistols 22.1 and 22.2 to move at right angles to the transport direction. The possible travel distance of the two spray pistols 22.1 and 22.2 is chosen sufficiently large to enable the two pistols to be moved through the depth T of the workpiece 4' and to coat the corresponding area. In order to assure that the two spray pistols 22.1 and 22.2 can provide an adequate powder covering for the ceiling and also the side walls and the floor of the two hollows 4.2 and 4.3, the mountings 60 enable the two spray pistols 22.1 and 22.2 to rotate, respectively, about the rotation axes A1 and A1'. Furthermore, the nozzles of the two spray pistols 22.1 and 22.2 are arranged in such a manner that the principal spraying direction differs by a predefined angle $\alpha$ from, respectively, the rotation axes A1 and A1', see FIG. 3. It is therefore possible to keep turning, for example, the spray pistol 22.2 until its principal spraying direction points to the upper edge 4.4 of the hollow 4.3. If the spray pistol 22.2 is then moved in the z-direction with the help of the linear axle 24.2, it is easy for the edge 4.4 to be uniformly coated. These considerations apply analogously also as regards the second spray pistol 22.1.

Advantageously, the spray pistols 22.1 and 22.2 will be mounted on respective extension pieces 25.1 and 25.2. This assures that even long hollows with small aperture diameter can be coated. In order to permit complete and uniform coating even of vertical areas, the two spray pistols 22.1 and 22.2 can be moved also in the y-direction with the help of the two linear axles 23.1 and 23.2.

The rotation angle $\omega$ through which the two spray pistols 22.1 and 22.2 can be rotated depends on the technical compatibility conditions that have to be satisfied.

The linear axles 24.1, 24.2, 25.1 and 25.2 may be designed as piston-rod-free linear axles with toothed belts. This has the advantage that the drive is protected against powder dust. The linear axles 24.1, 24.2, 25.1 and 25.2 may be driven either electrically or pneumatically.

By means of the invention a ring-shaped powder layer can be applied very simply to a vertical area, since one has to do nothing other than rotate the spray pistol about its longitudinal axis, i.e. the rotation axis A1".

When workpieces with a large radius have to be coated, the necessary radius can be produced by means of a rotation of the spray pistol and an additional displacement of the spray pistol in the y- and x-direction along the linear axles. At the same time the spray pistol can be made to follow the workpiece on its way through the booth by displacing the guide arm in the x-direction and therefore parallel to the workpiece.

An example of a possible further application of the powder coating installation in accordance with the invention consists of the coating of wheel rims for motor vehicles. The shape of the rim can be followed at a constant distance by the rotation of the spray pistol. The computational effort for controlling the movement of the spray pistol is minimal.

Figure 3:
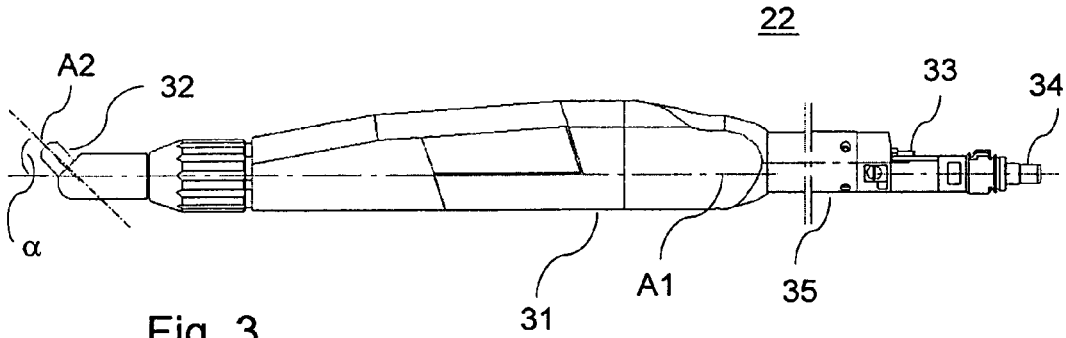
FIG. 3 shows a side elevation of a possible embodiment of a powder spray pistol that can be used with the installation in accordance with the invention.

FIG. 3 shows the side elevation of a possible design of a spray pistol 22 that could be used in the installation in accordance with the invention. The spray pistol 22 comprises a pistol housing 31 at the forward end of which there is arranged a nozzle 32. The principal jet direction or principal spraying direction of the nozzle 32 is indicated by the axis A2. The principal jet direction A2 indicates the direction in which the powder is mainly sprayed by the nozzle. A nozzle with a circular opening will produce a cone-shaped powder jet and the principal jet direction is represented by the axis of symmetry of the cone. The principal jet direction A2 will differ by the angle $\alpha$ from the longitudinal axis A1 of the spray pistol 22. When the spray pistol 22 is made to rotate through an angle $\omega=360°$ around its longitudinal axis A1, the nozzle 32 will spray the powder onto a ring-shaped area if the surface to be coated is arranged at a right angle with respect to the longitudinal axis of the spray pistol 22. The diameter of the ring will depend among others on the angle $\alpha$ and the distance between the surface and the nozzle 32. Depending on the orientation of the workpiece to be coated and the alignment of the nozzle 32, it is also possible to produce other shapes.

The angle $\alpha$ may, for example, lie between 0 and 90 degrees.

The spray pistol 22 is supplied with compressed air and powder via the connections 33 and 34. The spray pistol 22 is also provided with an electrical connection to permit the powder to be eletrostatically charged.

Figure 4:
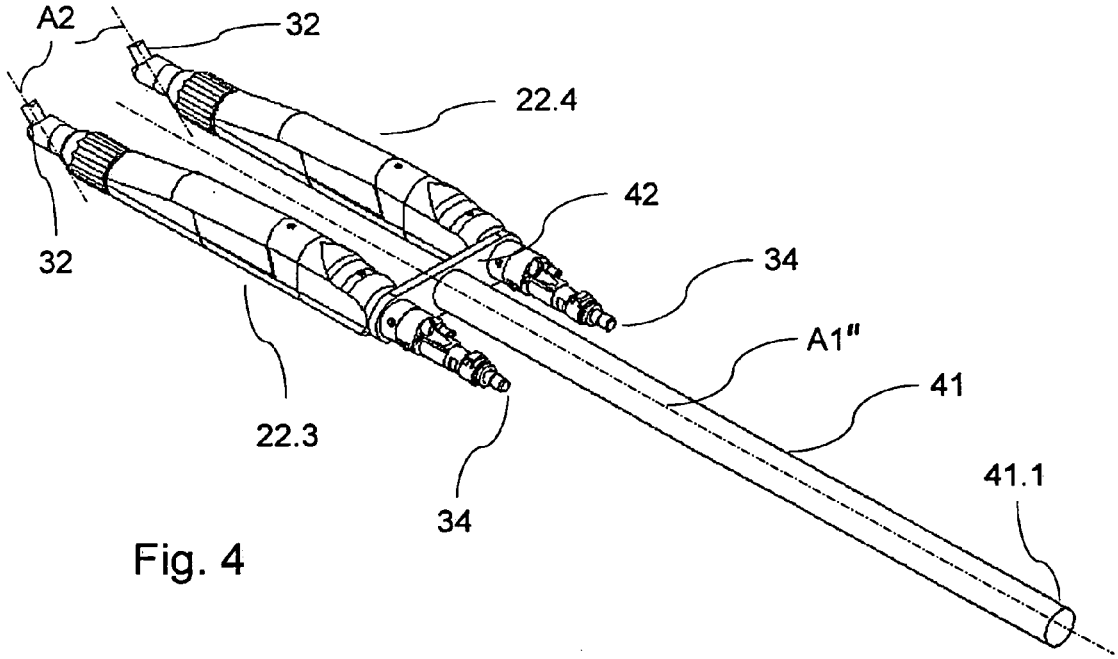
FIG. 4 shows, again in the form of a conceptual sketch, a possible arrangement of two powder spray pistols that can be used with the installation in accordance with the invention.

The length of the throat 35 of the spray pistol 22 is designed to match the technical requirements. In FIG. 4, for example, the pistol has a short throat 35.

In case of need, for example, two spray pistols 22.3 and 22.4 can be arranged side by side by means of a common extension piece 41, 42, as is shown in FIG. 4. To this end the two spray pistols 22.3 and 22.4 are joined to each other by means of the crosspiece 42. The crosspiece 42 is attached to a tubular extension piece 41 that, in its turn, is joined at its end 41.1 to the guide arm 27 by means of a mounting 60, as is shown, for example, in FIG. 5. In the case of the design shown in FIG. 4, the two spray pistols 22.3 and 22.4 do not rotate about their own longitudinal axes, but around the longitudinal axis A1" of the extension piece 41. The principal spraying direction of the two spray pistols 22.3 and 22.4 again differs by a predefined angle $\alpha$ from the axis A1". Consequently, just as has already been described in connection with FIG. 3, the two spray pistols 22.3 and 22.4 can be used to produce, for example, ring-shaped patterns.

Figure 5B:
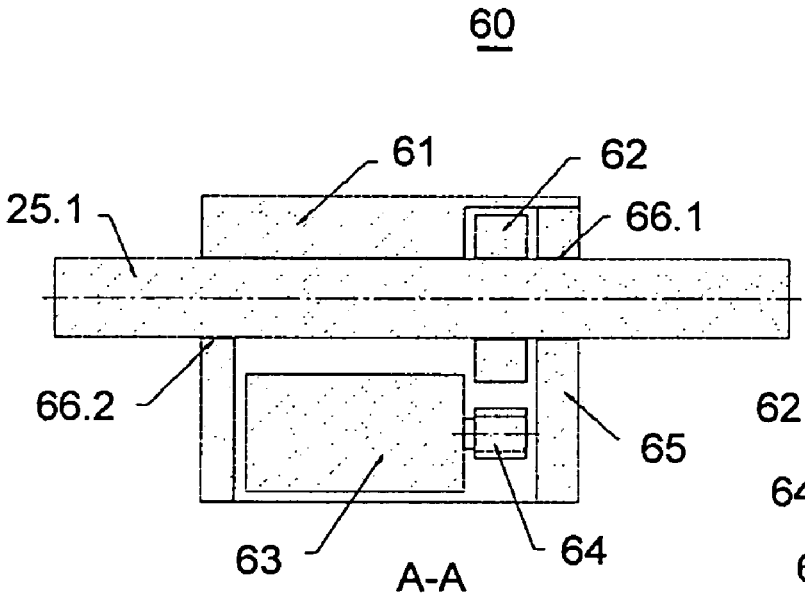
FIG. 5B shows a section through the mounting in accordance with FIG. 5A.
Figure 5A:
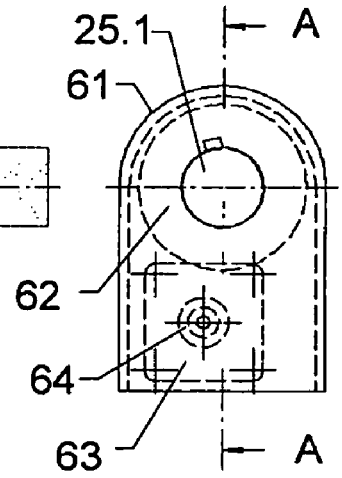
FIG. 5A shows the structure of a mounting for a spray pistol as seen from above.

In order to permit the spray pistols 22.1, 22.2, 22.3 and 22.4 to be rotated about the axis A1, A1' or A1", the spray pistols, either directly or via the extension pieces 25.1 or 41, are supported in a mounting 60 that is provided with a rotation drive. FIG. 5A illustrates the general principle of a possible design of such a mounting as seen from above. The extension piece 25.1 is supported in the housing 61 of the mounting 60 by means of a first and second bearing 66.1 and 66.2. Advantageously, the two bearings 66.1 and 66.2 are designed to be dustproof, so that powder dust cannot penetrate into the interior of the housing. In order to permit the interior of the housing to be accessed, the housing 61 is closed with a lid 65 that preferably closes the housing 61 in a dustproof manner. A drive, preferably a step motor 63, is arranged in the interior of the housing and, via a gear wheel 64, drives another gear wheel 64 that, in its turn, is either integral with the extension piece 25.1 or joined to it in such a manner as to transmit (rotational) forces. The alignment of the nozzle 32 of the spray pistol 22 can thus be determined by means of the step motor 63 in a very simple manner. FIG. 5B shows a section through the mounting 60. The section line coincides with the line A—A shown in FIG. 5A.

The above description of embodiments in accordance with the present invention is intended only for illustrative purposes and not for the purpose of limiting the invention. Various changes and modifications are possible without thereby overstepping the scope of the invention and its equivalents.

What is claimed is:

1. An installation for coating a workpiece with powder, wherein there is provided a first powder spray device with a first principal spraying direction, wherein said first powder spray device is supported in such a manner as to capable of being rotated with respect to a first carrier element, about a first rotation axis and said first principal spraying direction differs from said first rotation axis, wherein there is provided a second powder spray device with a second principal spraying direction, wherein said second powder spray device is supported in such a manner as to capable of being rotated with respect to a second carrier element, about a second rotation axis and said second principal spraying direction differs from said second rotation axis, wherein a guide arm is provided, to which said carrier elements are attached, and wherein said powder spray devices are separately translatory movable.

2. An installation in accordance with claim 1, wherein said rotation axes run parallel to said longitudinal axes of said powder spray devices.

3. An installation in accordance with claim 1, wherein said powder spray device is provided with a nozzle and the alignment of said nozzle defines said principal spraying direction.

4. An installation in accordance with claim 1, wherein said powder spray device is designed as a spray pistol.

5. An installation in accordance with claim 1, wherein there is provided a booth and said powder spray device into said booth, and wherein said guide arm and said mounting are arranged outside said booth.

6. An installation in accordance with claim 1, wherein on the guide arm there is provided a first linear axle by means of which said powder spray device can be made to perform translatory movements along a first axis.

7. An installation in accordance with claim 6, wherein said first linear axle is coupled with a second linear axle by means of which said powder spray device can be made to perform translatory movements along a second axis.

8. An installation in accordance with claim 1, wherein said carrier element is provided with a drive for the rotation of said powder spray device.

9. An installation in accordance with claim 8, wherein said drive is provided with a step motor.

10. An installation in accordance with claim 1, with a further powder spray device.

11. An installation in accordance with claim 10, wherein said further powder spray device is connected with said guide arm.

12. An installation in accordance with claim 1, wherein there is provided a control unit for the rotation and the translations of said powder spray device.

13. An installation in accordance with claim 7, wherein there is provided a third linear axis by means of which said guide arm is arranged in a mobile manner on a third axis.

* * * * *